US006553699B2

(12) United States Patent
Edmunds et al.

(10) Patent No.: US 6,553,699 B2
(45) Date of Patent: Apr. 29, 2003

(54) DISPLAY DEVICE

(75) Inventors: Marc Edmunds, London (GB); Andrew Hall, London (GB)

(73) Assignee: Hive Media LTD, London (GB)

( * ) Notice: Subject to any disclaimer, the term of this patent is extended or adjusted under 35 U.S.C. 154(b) by 0 days.

(21) Appl. No.: 09/799,725

(22) Filed: Mar. 7, 2001

(65) Prior Publication Data

US 2002/0095843 A1 Jul. 25, 2002

(30) Foreign Application Priority Data

Jan. 24, 2001 (GB) ..... 0101855

(51) Int. Cl.[7] ..... G09F 15/00; G09F 19/14
(52) U.S. Cl. ..... 40/624; 40/453
(58) Field of Search ..... 40/453, 454, 624, 40/605

(56) References Cited

U.S. PATENT DOCUMENTS 824,860 A * 7/1906 Grove ..... 40/453
1,809,378 A * 6/1931 Eschenbach ..... 40/438
3,082,560 A * 3/1963 Elvestrom ..... 40/437
5,600,910 A * 2/1997 Blackburn ..... 40/605
5,699,190 A 12/1997 Young et al. ..... 359/619
5,724,758 A * 3/1998 Gulick, Jr. ..... 40/453
5,926,154 A 7/1999 Hirono et al. ..... 345/5
5,959,718 A 9/1999 Morton ..... 355/22
6,004,421 A * 12/1999 Landa ..... 40/624
6,163,406 A 12/2000 Morton ..... 359/619
6,226,906 B1 * 5/2001 Bar-Yona ..... 40/437

* cited by examiner

*Primary Examiner*—D. Glenn Dayoan
*Assistant Examiner*—Jason R. Bellinger
(74) *Attorney, Agent, or Firm*—Finnegan, Henderson, Farabow, Garrett & Dunner, L.L.P.

(57) ABSTRACT

A display device for large scale billboard displays comprises a set of image carriers each defining a respective sequence of image frames and each having directional properties such that different image frames are viewable from different viewing directions relative to the image carrier. A support device supports the image carriers such that they together form a composite display and an adjustment device is provided operable to adjust the orientation of the image carriers relative to the support device such that corresponding frames of each image carrier are simultaneously viewable by an observer at a predetermined position relative to the display apparatus. The image carriers may be lenticular members in which lenticular lenses overlay interdigitated strips of image elements.

19 Claims, 9 Drawing Sheets

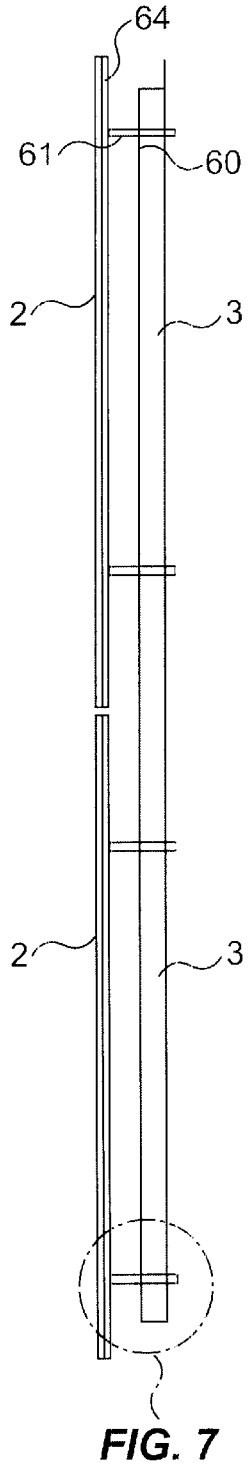
FIG. 7
FIG. 6A
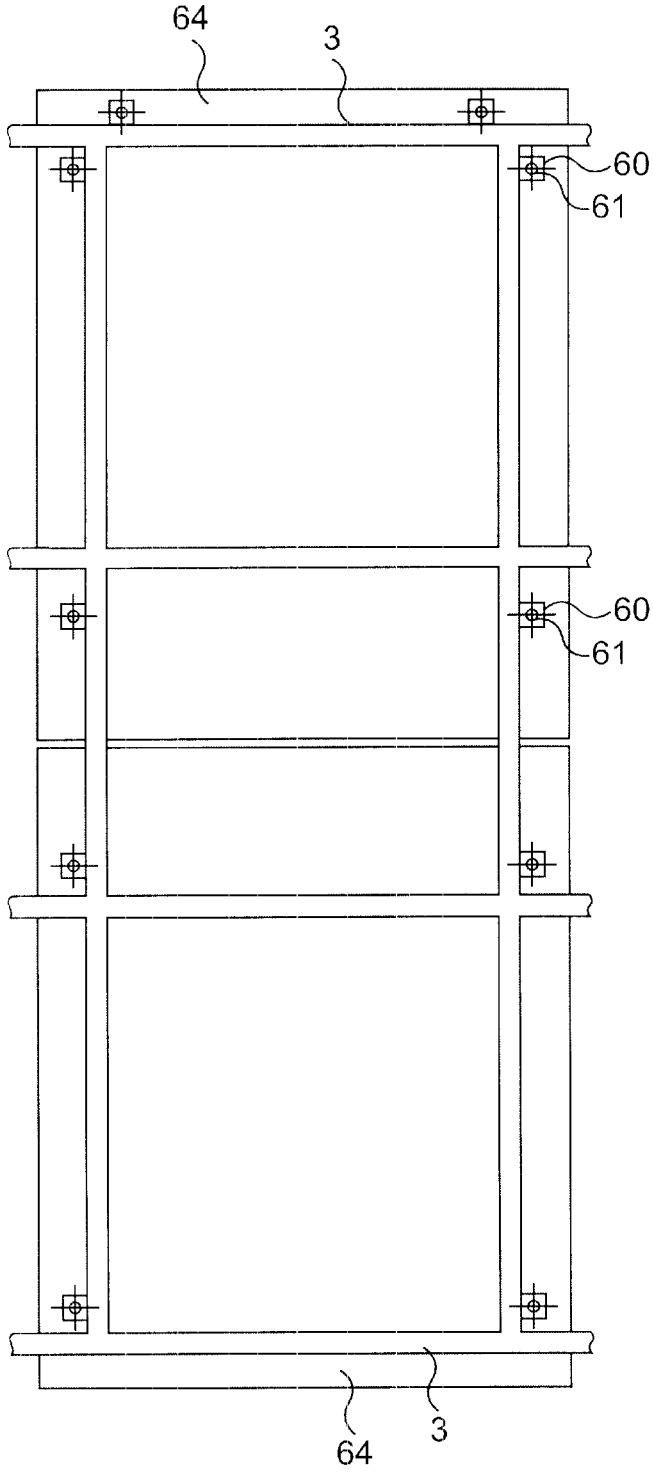
FIG. 6B

DISPLAY DEVICE

BACKGROUND OF THE INVENTION

This invention relates to display devices of the type in which relative movement between an observer and the display presents successive frames of a moving image by virtue of directional properties of an image carrier forming part of the display device. The invention relates in particular, but not exclusively, to display devices comprising large scale advertising hoardings formed from a set of panels, and wherein the image carrier displaying the moving image comprises a lenticular member having a plurality of lenticular lenses which overlay an image hearing member upon which inter-digitated image elements are formed. Examples of such lenticular media are described in U.S. Pat. No. 5,699,190 and U.S. Pat. No. 5,959,718 and are commercially marketed by Eastman Kodak (Trade Mark) as Dynamic Imaging materials.

It is known to provide an advertising hoarding formed of a number of panels in which an image carrier is mounted on a single one of the panels and defines a moving image by virtue of the directional properties of the image carrier. Such displays are effective in attracting the attention of pedestrians and travellers in moving vehicles, the moving image typically being formed by animated photographic or graphics techniques or by use of actual events captured using a cine-camera or video camera.

Typically in such advertising hoardings the image carrier on the single panel providing the moving image is accompanied by a series of fixed image panels carrying text or other fixed images not having directional properties to complete the advertising message. Typically, the entire hoarding cannot practically be formed of a single image carrier having directional properties because of cost and the technical implications of introducing a single large scale lenticular image medium.

BRIEF SUMMARY OF THE INVENTION

The present invention seeks to provide an improvement whereby more than one of the panels of the display may comprise an image carrier providing part of the same moving image. A problem anticipated with such composite displays is that the panels will generally be required to extend in a planar array, as for example along the side of a building, and the observer will observe the display at a distance which is determined by local topography such as the locations of a pavement, pathway or traffic lane. If for example more than one identical image carriers are simply mounted against the wall of the building in co-planar relationship and spaced apart in the direction of observer travel, the portions of moving image which the respective panels provide will not in general be simultaneously viewable from the same direction and therefore will not be in sync.

According to the present invention, a composite display is formed by a set of image carriers displaying multiple frames which are selectively viewable depending upon viewing direction and wherein the image carriers are supported such that their orientations can be adjusted. The image carriers each include at least one frame recognisable as being a reference frame so that during an on-site alignment procedure the image carriers can be adjusted in orientation such that the reference frames of each image carrier are simultaneously viewable by an observer at an alignment position. This ensures that the frames of the moving image provided by each image carrier are in sync with the frames of the moving image provided by the other image carriers of the set.

A further aspect of the invention provides image carriers for which the viewing angle corresponding to the reference frame is determined during a manufacturing process according to the position which the image carrier will adopt when assembled into the array of image carriers forming the composite display, thereby minimising the need for adjustment in orientation during the onsite alignment procedure. Typically therefore, image carriers which are to be located at an array position at the centre of the composite display may have a viewing angle for the reference frame which is at or about 90° relative to the planar extent of the image carrier whereas those image carriers which are intended to be located at the periphery of the composite image may have a viewing angle which is less than 90°.

During the onsite alignment procedure, it is necessary for the reference frame to be readily recognised by operatives performing the alignment and therefore a further aspect of the invention relates to providing means for recognising the reference frames such as by the inclusion in the reference frame image of indicia such as a symbol. In the preferred embodiment, the symbols are square markers, such symbol being placed at suitable locations in the image frame so as not to obscure the image information.

BRIEF DESCRIPTION OF THE DRAWINGS

Preferred embodiments of the present invention will now be disclosed by way of example only and with reference to the accompanying drawings of which;

FIG. 6A is a side elevation of two image carriers on panels supported adjustably on a supporting frame;

FIG. 6B is a rear elevation of the panels and the supporting frame of FIG. 6A;

DETAILED DESCRIPTION

Figure 1:
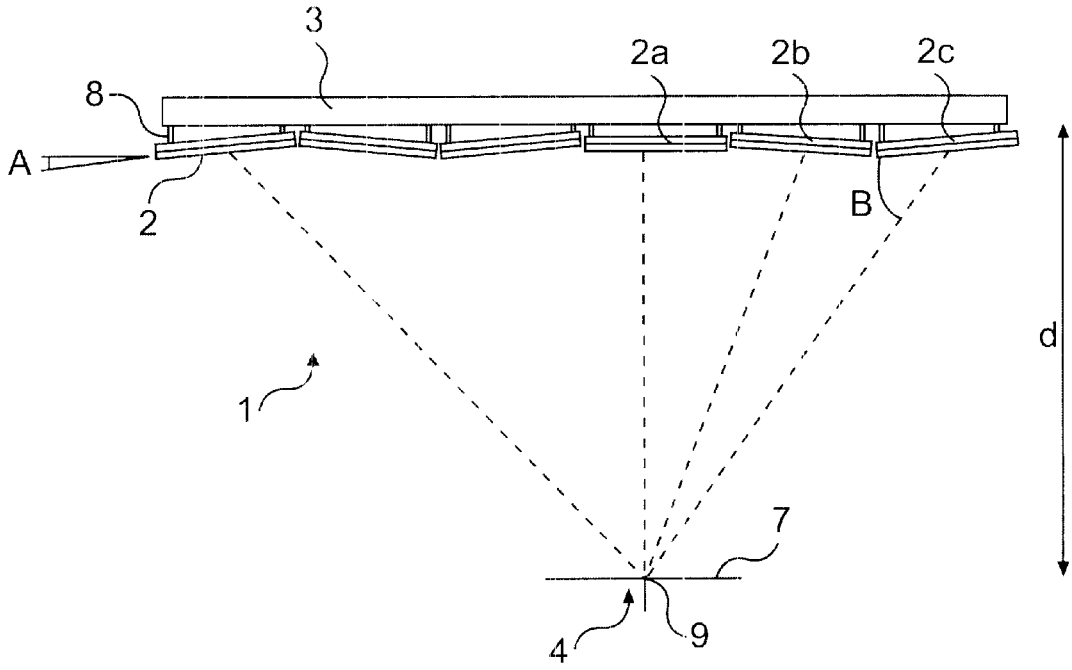
FIG. 1 is a schematic plan view of a composite display.

FIG. 1 illustrates in plan view a composite display 1 for use as an advertising hoarding formed by a set of image carriers 2 which are supported by a support frame 3 so as to be viewable in a generally horizontal direction by an observer 4.

Figure 2:
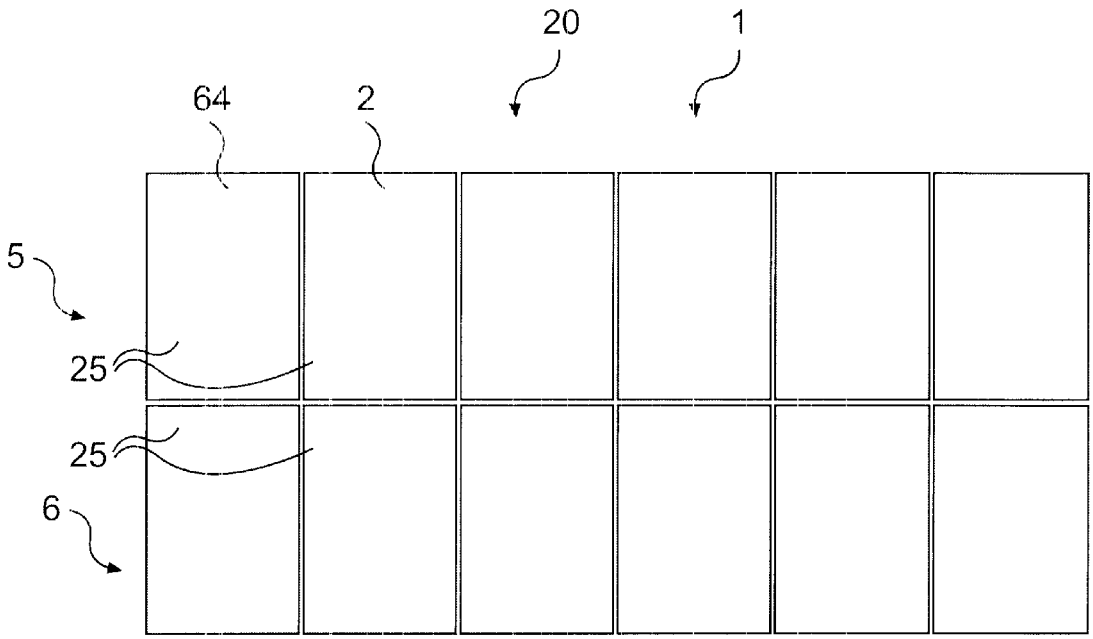
FIG. 2 is a schematic front elevation of the composite display of FIG. 1.

FIG. 2 illustrates in front elevation the image carriers 2 being twelve in number and arranged to form a 6×2 array in which an upper row 5 of six image carriers is supported above a lower row 6 of a further six image carriers.

The display 1 is intended to be viewed by the observer 4 at any of a number of viewing positions along a horizontally extending viewing path 7 which runs parallel to and at a distance d from the display 1. Movement of the observer 4 along path 7 results in successive image frames in the sequence being viewable, thereby enabling the appearance of a moving image to be created.

Each of the image carriers 2 is mounted on a rectangular panel 64 having a long axis which is vertical and a short axis which is horizontal. Each panel 64 is mounted to the support frame 3 by adjustable couplings 8 which facilitate adjustment of the orientation of the panel through a range of about ±5 degrees about both vertical and horizontal axes. The panel 64 can therefore be adjusted in orientation about the vertical axis to a tilt angle A between the plane of the image carrier 2 and a vertical plane defined by the support frame 3. In FIG. 1, the size of angle A is exaggerated for illustration purposes and this figure is therefore not to scale in this respect.

Each of the image carriers 2 has directional characteristics by virtue of lenticular Dynamic Imaging materials, described below, such that the observer 4 sees the composite image of the display 1 as a sequence of different image frames when the observer moves along the viewing path 7. In the present example, the sequence of image frames is recorded using a video camera and processed to form a pattern of interlaced image strips suitable for lenticular imaging before being transferred to the image carriers by exposure of photographic emulsion.

In the display 1 of the present example, the image carriers 2 are arranged such that the longitudinal axis of the lenticular material (i.e. the lenticular axis) extends vertically.

Figure 3:
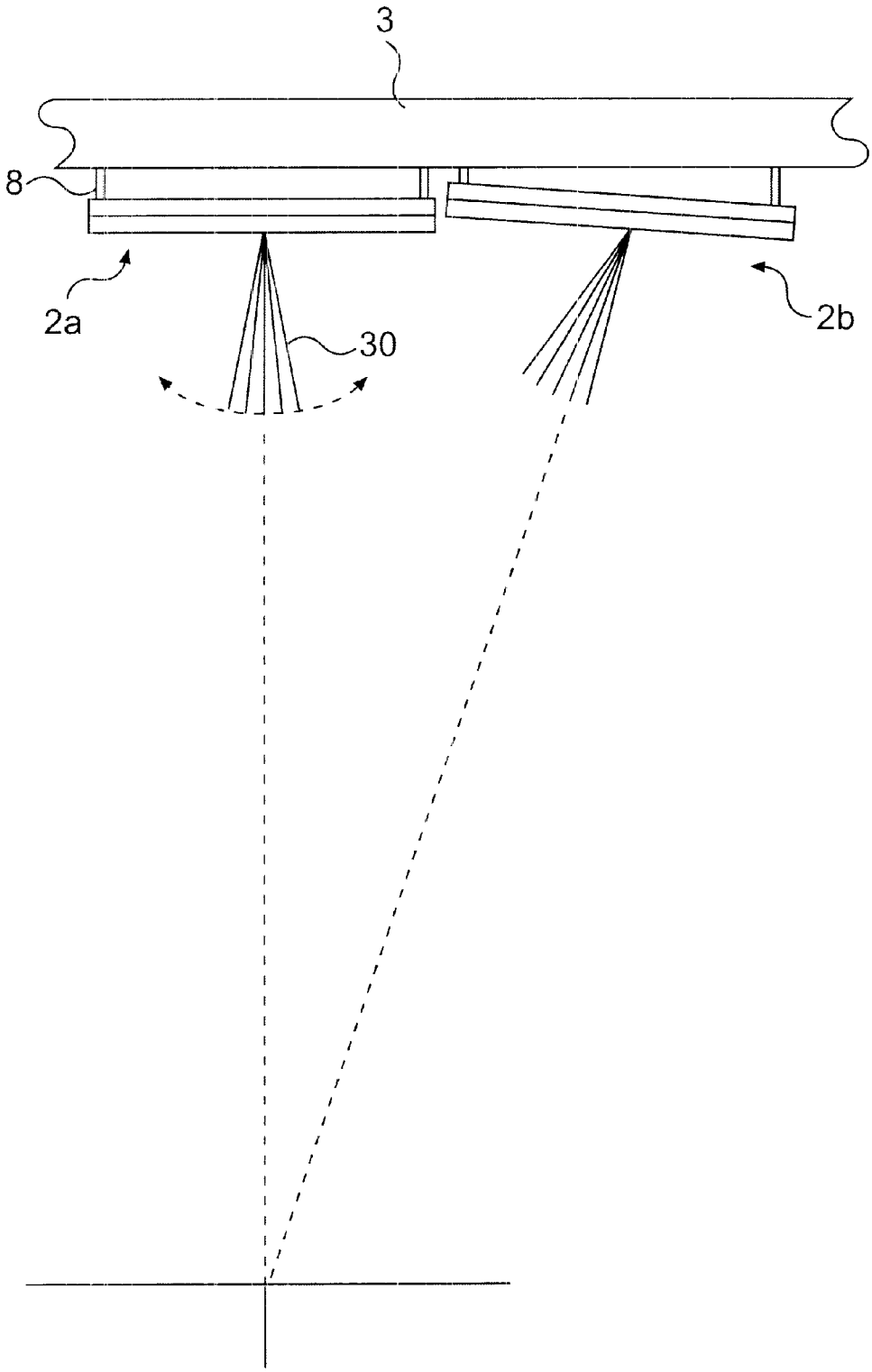
FIG. 3 is an enlarged plan view of part of the composite display of FIG. 1.

FIG. 3 shows in greater scale the image carriers 2*a* and 2*b* of FIG. 1. Image carrier 2*a* is manufactured to display a sequence of 21 image frames, each of which is viewable at a respective horizontal viewing direction represented schematically in FIG. 3 by a number of lines 30 radiating from a vertical axis in the image carrier, each line representing a viewing direction at which one of the image frames of the moving image is viewable. Vertical movement of the observer 4 does not change the viewing direction in the above sense since it is the angle about the lenticular axis of the lenticular material which determines which image frames are viewable.

As illustrated in FIG. 2, an image presented by a composite image area 20 is formed from a set of image segments 25 provided by respective image carriers 2. Each image segment 25 however can at a given time be selectively viewed as any one of frames 1 to 21 of the image frames provided by its respective image carrier 2. There is therefore a requirement for the observer 4 on the viewing path 7 to simultaneously view image segments 25 having the same frame number in the sequence which defines the moving image. Each of the image carriers 2 is manufactured to have directional properties selected with the intention that this requirement should be met for a given value of distance d when the image carriers are mounted in co-planar relationship thereby requiring zero adjusting angle A in each case. However, manufacturing tolerances associated with the lenticular material typically do not achieve this degree of alignment. Furthermore, the manufacture will set the viewing angles for each image carrier with a particular value of distance d in mind. If the value of d is to be changed for a particular application of the display, image segments having the same frame number will no longer be simultaneously viewable along the new viewing path 7.

For the above reasons, the adjustable couplings 8 generally need to be set on site to ensure that for any given position along the viewing path 7, image segments having the same frame number are simultaneously viewable in each of the image carriers 2. This synchronisation process will now be described as part of the overall process of forming the image carriers 2 and mounting them in the composite display 1.

The process of manufacturing the image carriers 2 begins by obtaining a series of 21 images which are to constitute the composite image area 20 and which when viewed in numerical sequence are perceived as a moving image. Each image is divided into the twelve image segments 25 shown in FIG. 2 so as to correspond to the image areas which will be presented by respective image carriers 2 when mounted in array on the support 3.

For each image carrier 2, a sequence of 21 image frames then corresponds to the sequence of image segments 25 for that image carrier. The frames are numbered sequentially in the order in which they are to be viewed.

Figure 4:
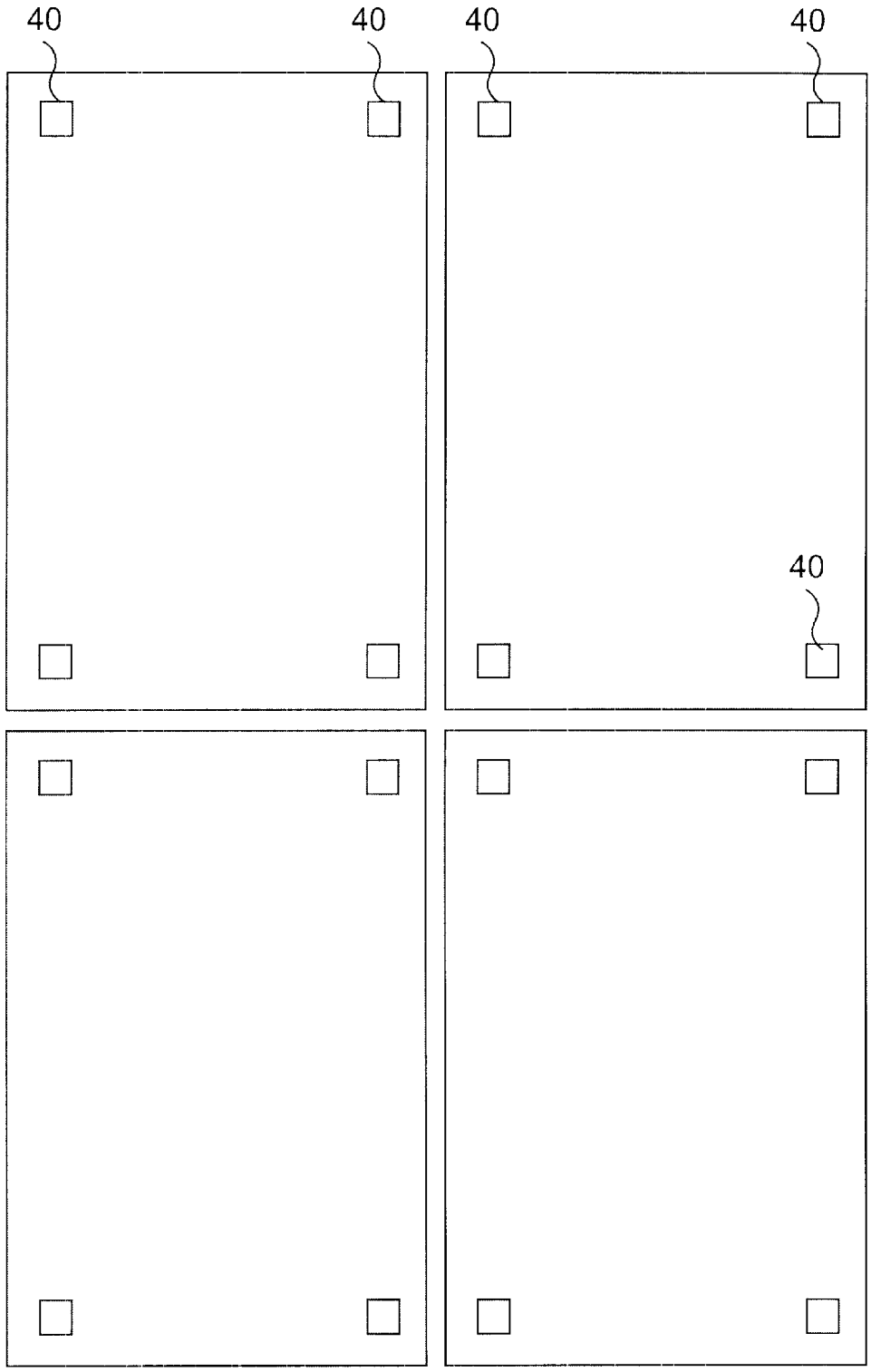
FIG. 4 is a view as seen by an observer located at an alignment position relative to the part of the display shown in FIG. 3.

The design parameters for the display 1 then need to be determined as shown in FIG. 1 since it is necessary to have knowledge of the dimensions of the panels 64 and the distance d from which the display 1 will be viewed. As a reference position for alignment purposes, an alignment position 9 on the viewing path 7 is selected. This allows calculation of the angles B relative to each image carrier 2 at which it is to be viewable from the alignment position 9. One of the frames is selected during manufacture to be used in the on-site alignment process. In the present example, an alignment reference frame number 10 is chosen. As an aid to recognition of the alignment reference frame 10, the number 10 frame of each image carrier 2 is modified during manufacture by the addition of one or more reference symbols 40, as illustrated in FIG. 4 where the reference symbols are in the form of squares with one symbol being located in each corner of the frame.

Figure 5A:
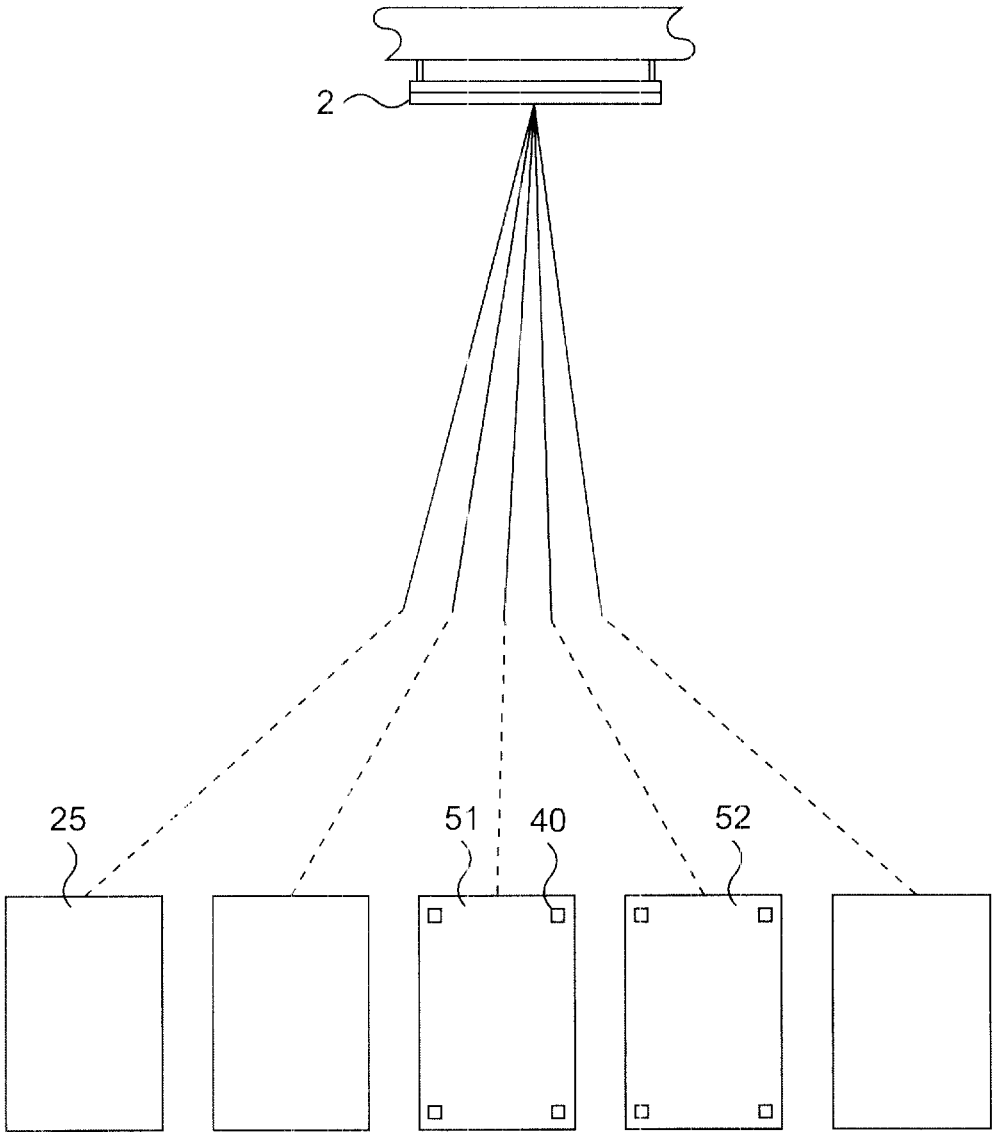
FIG. 5 is a plan view of one of the image carriers of FIG. 3 showing successive frames of a sequence of frames viewable at different viewing directions relative to the image carrier.
Figure 5B:
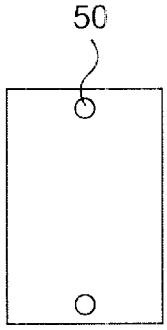

Using the values of angle B for each of the image carriers 2, it is also possible to determine for a given image carrier the number of the frame which would be viewable at a viewing angle of 90°. Frames of this number are marked with a different symbol, referred to hereafter as a manufacturing reference symbol, so that it is also possible to recognise these frames during manufacture. For example, image carrier 2*c* in FIG. 1 requires a viewing direction of B=45° to view the alignment reference frame 10. If however image carrier 2*c* is viewed in a direction at right angles to the plane of the image carrier, frame 15 is viewable. Frame 15 is therefore marked for recognition purposes with the manufacturing reference symbol 50 which in this example is a circle as shown in FIG. 5B.

Figure 8A:
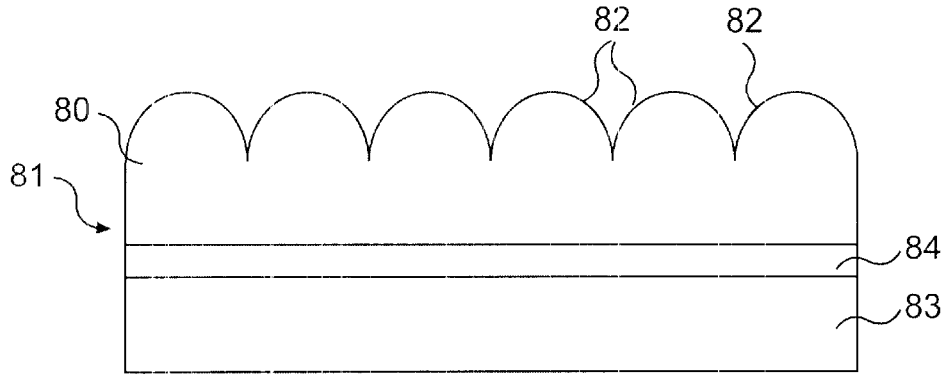
FIG. 8A is a sectional view of a lenticular image carrier.
Figure 8B:
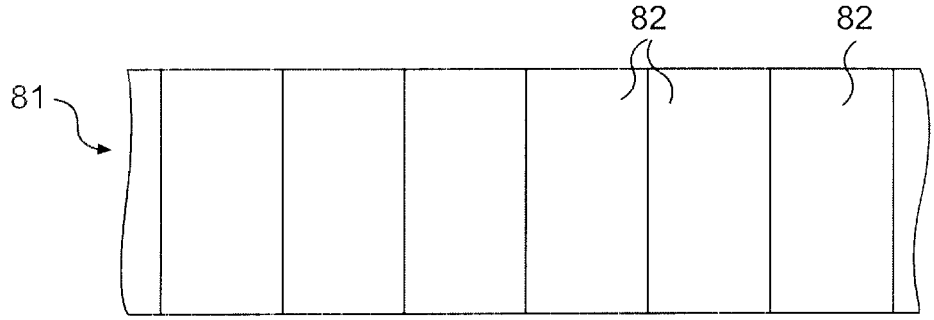
FIG. 8B is a front elevation of the image carrier of FIG. 8A.
Figure 8C:
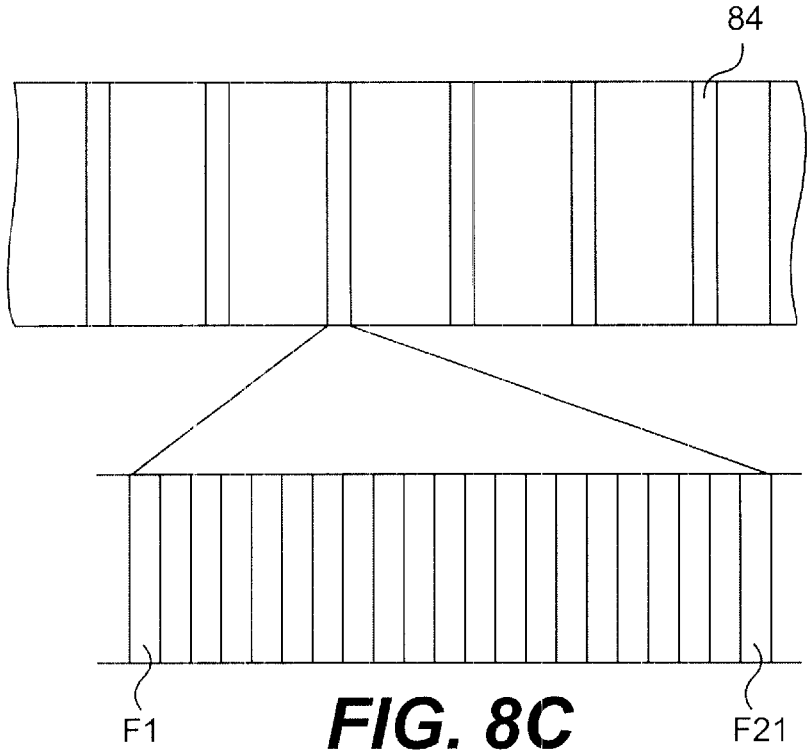
FIG. 8C is a view of the image bearing member of the image carrier of FIG. 8A showing the image strips.

For each of the image carriers 2, a lenticular member 80 in the form of an extruded sheet 81 of Polyethylene Terethphalate having a shape defining parallel lenticles 82 is mounted in contact with an image bearing member 83 carrying inter-digitated image strips 84 as shown in FIGS. 8A, 8B and 8C.

Each image strip 84 consists of a sequence of frame elements belonging to different frames as illustrated in the lower portion of FIG. 8C which shows an image strip having frame elements F1 to F21. The order of frame elements corresponds to the sequence of image frames seen by the observer 4. For those image carriers 2 which are peripheral in the array, the sequence of frame numbers is modified for example so as to commence with F5 to F21, followed by frames F1 to F4. Such shifting of the frame numbers allows the image carriers to be substantially coplanar and avoids the need for large values of tilt angle A during assembly.

In FIG. 8C, the complete image frame number 1 for example will be formed by the composite image formed by viewing the inter-digitated frame elements F1 from each of the image strips 84 through the lenticular member 80.

An alcohol based lubricant is used to allow the lenticular member 80 to be adjusted in position in contact with the image bearing member 83, the adjustment being carried out until the manufacturing reference symbols 50 are viewable in a viewing direction of 90°. The relative position of the lenticular member 80 and image strips affects the directional properties of the image carrier 2 so that this alignment step during manufacture requires high tolerance. Inevitably however, some residual error may remain.

Once the required position has been determined for the lenticular member 80, a hardening process utilising exposure to ultraviolet light is used to bond the lenticular member 80 to the image bearing member 83 in fixed relationship. This process is repeated for each of the image carriers 2.

The image carriers 2 are then mounted on the rigid panels 64 which in turn are mounted on the support frame 3 in their allotted array positions as shown in FIG. 1. The observer 4 at the alignment position 9 should be able to see in each image segment 25 provided by the image carriers 2 the alignment reference symbols 40. For each image carrier 2 where this is not the case, adjustment of the orientation of the image carrier relative to the support frame 3 is necessary and this requires actuation of the adjustable coupling 8 attached to each corner of the panel 64 upon which the image carrier is mounted.

Figure 7:
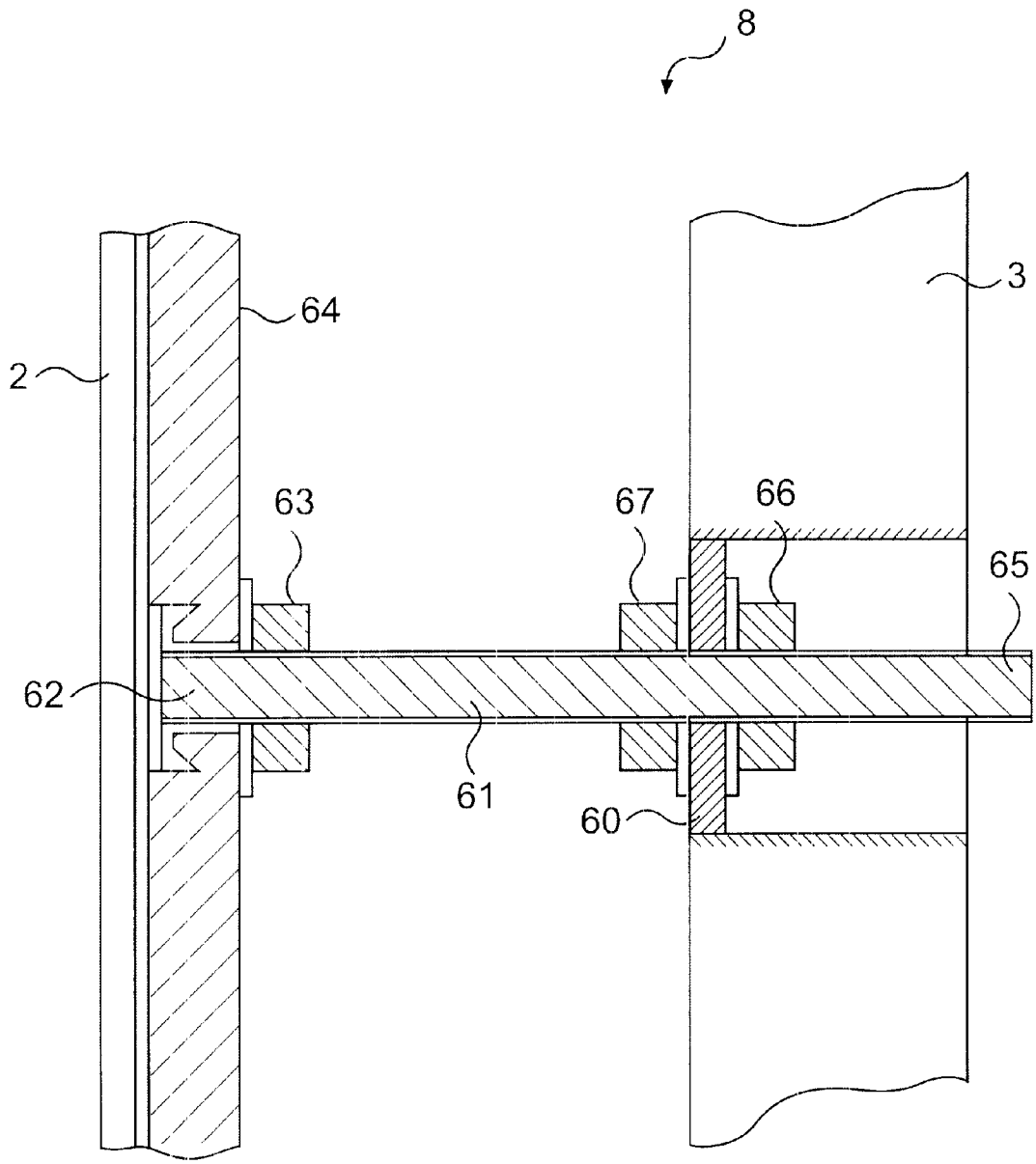
FIG. 7 is a detail from FIG. 6A of the adjusting mechanism between one of the panels and the supporting frame.

The adjustable couplings 8 are illustrated in FIGS. 6A, 6B and 7. As shown in FIG. 6B and in greater detail in FIG. 7, the support frame 3 is formed from a steel box frame to which a number of flanges 60 are mounted, each flange defining an aperture through which a screw studding 61 slidably extends. Each studding 61 has a first end portion 62 which is fixedly secured by a lock nut 63 to the panel 64 upon which the image carrier 2 is mounted. The panel 64 is formed of rigid plywood of sufficient thickness to substantially prevent bending in use. The studding 61 has a second end portion 65 which projects rearwardly from the flange 60, thereby facilitating adjustment of the separation between the panel 64 and the flange 60.

During the alignment procedure, the panel 64 is adjusted in orientation by an operative until the observer 4 confirms visibility of the alignment reference symbols 40.

The position of the studding 61 relative to the support frame 2 is then secured by tightening locking nuts 66 and 67 on opposite sides of the flange 60.

The second end portion 65 may then be cut so as to no longer project rearwardly of the support frame 3. The alignment procedure may require adjustment of each of the four adjustable couplings 8 located at corners of the panel.

In the above description, a single image frame (number 10) is selected to be the reference frame for alignment purposes. Alternatively, two adjacent image frames in the sequence may be selected for reference purposes and may each be marked with the alignment reference symbols 40 as shown in FIG. 5A. In FIG. 5A, a series of image segments 25 corresponding to successive image frames are illustrated for a single one of the image carriers 2. Adjacent reference frames 51 and 52 each include alignment reference symbols 40.

The provision of such multiple adjacent reference frames makes it easier for the observer to recognise the presence of a reference frame and allows greater tolerance in adjusting the position of the panels 64 during onsite alignment.

Figure 9:
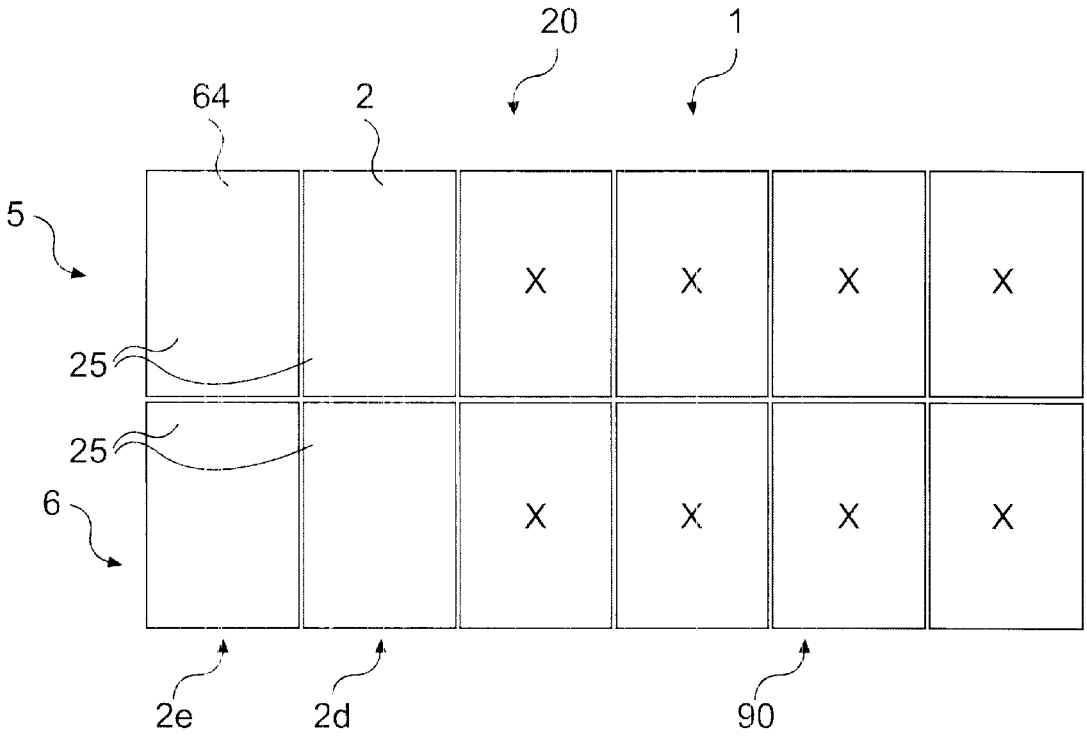
FIG. 9 is a front elevation of an alternative display in which some of the panels do not have image carriers with directional properties.

In an alternative embodiment, not all of the panels 64 carry image carriers 2 having directional viewing properties. In FIG. 9 for example, those panels 90 marked with an X do not carry direction dependent image carriers and may simply carry conventional posters with images carrying text or other matter which complements the moving image provided by the direction dependent image carriers 2 occupying the remainder of the display In the example of FIG. 9, image carriers 2*e* and 2*d* have viewing angles B of 90° and 45° respectively when observed during the alignment process described above.

In the embodiment of FIG. 1, the size of the display is approximately 10 ft in height and 20 ft in length with a typical value of distance d of 2 ft. The lenticular material is dimensioned to have 22 lenticles per inch.

The above described embodiments refer to image carriers in the form of lenticular media. Other forms of image carrier may alternatively be utilised as for example holographic devices or fly-eye lenses. Alignment about both horizontal and vertical axes may then be desirable.

In the case of lenticular material, the lenticular axis may in alternative embodiments be aligned horizontally for viewing by passengers moving vertically as in the case of an ascending escalator.

The panels 64 may alternatively be formed from a rigid plastics material.

Although in general it will be necessary to adjust the coupling 8 on site as described above, the alignment may be pre-set during an alignment procedure carried out at a manufacturing site and the panels then shipped together with the support frame to the actual site for deployment.

In the above described embodiments, the images forming the sequence of frames may be produced using animated photographic techniques using still cameras, cine cameras or video cameras. Other techniques may also be used including the use of graphics, either generated by hand or by computer, or any combination of the above.

What is claimed is:

1. Display apparatus comprising a set of image carriers, each image carrier defining a respective sequence of image frames and each image carrier having directional properties such that different image frames are viewable from different viewing directions relative to the image carrier;

support means for supporting the image carriers such that they together form a composite display; and adjustment means operable to independently adjust the orientation of each image carrier relative to the support means during an alignment procedure and to thereafter maintain the image carriers in independently fixed relationships to the support means such that corresponding frames of each image carrier are simultaneously viewable by an observer at a predetermined position relative to the display apparatus.

2. Display apparatus as claimed in claim 1 wherein each image carrier comprises a reference frame at a selected position in the sequence of image frames and indicia means facilitating recognition of the reference frame when viewed by the observer at the predetermined position.

3. Display apparatus as claimed in claim 2 wherein the indicia means comprise at least one symbol inserted into the viewable image area of the reference frame.

4. Display apparatus as claimed in claim 3 wherein the image area is rectangular and the indicia means comprises symbols located in at least one corner portion of the rectangular image area.

5. Display apparatus as claimed in claim 2 wherein the reference frame of at least one of the image carriers is viewable in a viewing direction at 90° to a plane in which the image carrier extends and wherein the reference frame of at least one other of the image carriers of the set is viewable at an angle of less than 90° relative to a plane in which the at least one other image carrier extends.

6. Display apparatus as claimed in claim 5 wherein those image carriers for which the reference frame is viewable at a viewing direction less than 90° further comprise additional indicia means for identifying a further selected frame which is viewable at a viewing direction of 90°.

7. Display apparatus as claimed in claim 1 wherein each image carrier comprises an image bearing member carrying image strips overlaid by a lenticular member defining an array of lenticles parallel to a lenticular axis, wherein each image strip comprises a sequence of parallel frame elements defining image information corresponding to the sequence of frames, each image strip being overlaid by a respective lenticle, and wherein each of which frames is viewable as a composite image formed by interdigitated frame elements when viewed through the lenticular member in a respective radial direction relative to the lenticular axis.

8. Display apparatus as claimed in claim 1 wherein each image carrier is mounted on a panel and wherein the adjustment means comprises at least one screw coupling operable to mount a portion of the panel at an adjustable distance relative to the support means.

9. Display apparatus as claimed in claim 8 wherein the panels are rectangular and screw couplings are operable at corner portions of each panel.

10. An image carrier for use in display apparatus as claimed in claim 3, the image carrier comprising a set of image frames and at least one reference symbol inserted into the viewable image area of a reference frame selected from the set of image frames, said reference symbol being provided to allow said observer to recognize when said corresponding frames are simultaneously viewable during alignment.

11. An image carrier as claimed in claim 10 wherein each image frame comprises a rectangular image and wherein the at least one reference symbol is inserted into a respective corner portion of the image frame.

12. Apparatus comprising a support means for use in display apparatus as claimed in claim 1, the support means comprising a plurality of mountings which are cooperable in use with screw couplings for adjusting the orientation of the image carriers.

13. A method of forming a display apparatus comprising a set of image carriers each defining a respective sequence of image frames and each having respective directional properties such that different image frames are viewable from different viewing directions relative to the image carrier;

the method comprising:

supporting the image carriers on a support means such that they together form a composite display;

independently adjusting the orientation of the image carriers relative to the support means such that corresponding frames of each image carrier are simultaneously viewable by an observer at a predetermined position relative to the display apparatus; and securing the image carriers at the independently adjusted positions relative to the support means.

14. A method of forming a display apparatus comprising the steps of:

generating a sequence of images to be displayed;

dividing each image into image segments which are to be displayed on respective image carriers when mounted in an array forming a composite display and generating for each image segment a sequence of frames, said image carriers each having directional properties such that different image frames are viewable from different viewing directions relative to the image carrier;

for each image carrier, determining a geometrical relationship between a predetermined observation position at which the composite display is to be observed and a position at which the image carrier is to be mounted in the array to thereby determine a respective viewing direction for alignment purposes for each image carrier;

for each image carrier, applying indicia means to a reference frame selected from the sequence of frames carried by the image carrier; and recording the images in the image carriers such that for each image carrier the reference frame is viewable only when observed in a direction corresponding substantially to the respective viewing direction; and wherein the reference frame is recognisable by observation of the indicia means as an indicator of correct alignment.

15. A display apparatus comprising:

a set of image carriers each defining a respective sequence of image frames and each having directional properties such that different image frames are viewable from different viewing directions relative to the image carrier;

support means for supporting the image carriers such that they together form a composite display; and adjustment means operable to adjust the orientation of the image carriers relative to the support means such that corresponding frames of each image carrier are simultaneously viewable by an observer at a predetermined position relative to the display apparatus, each image carrier comprising a reference frame at a selected position in the sequence of image frames and indicia means facilitating recognition of the reference frame when viewed by the observer at the predetermined position, the reference frame of at least one of the image carriers being viewable in a viewing direction at 90° to a plane in which the image carrier extends and wherein the reference frame of at least one other of the image carriers of the set is viewable at an angle of less than 90° relative to a plane in which the other image carrier extends, and wherein those image carriers for which the reference frame is viewable at a viewing direction less than 90° further comprise additional indicia means for identifying a further selected frame which is viewable at a viewing direction of 90°.

16. A display apparatus comprising:

a set of image carriers each defining a respective sequence of image frames and each having directional properties such that different image frames are viewable from different viewing directions relative to the image carrier;

support means for supporting the image carriers such that they together form a composite display; and adjustment means operable to adjust the orientation of the image carriers relative to the support means such that corresponding frames of each image carrier are simultaneously viewable by an observer at a predetermined position relative to the display apparatus, wherein each image carrier is mounted on a panel and wherein the adjustment means comprises at least one screw coupling operable to mount a portion of the panel at an adjustable distance relative to the support means.

17. A display apparatus comprising:

a set of image carriers each defining a respective sequence of image frames and each having directional properties such that different image frames are viewable from different viewing directions relative to the image carrier;

support means for supporting the image carriers such that they together form a composite display; and adjustment means operable to adjust the orientation of the image carriers relative to the support means such that corresponding frames of each image carrier are simultaneously viewable by an observer at a predetermined position relative to the display apparatus, each image carrier being mounted on a panel and wherein the adjustment means comprises at least one screw coupling operable to mount a portion of the panel at an adjustable distance relative to the support means, and wherein the panels are rectangular and screw couplings are operable at corner portions of each panel.

18. A display apparatus comprising:

a set of image carriers each defining a respective sequence of image frames and each having directional properties such that different image frames are viewable from different viewing directions relative to the image carrier;

support means for supporting the image carriers such that they together form a composite display; and adjustment means operable to adjust the orientation of the image carriers relative to the support means such that corresponding frames of each image carrier are simultaneously viewable by an observer at a predetermined position relative to the display apparatus, wherein the support means comprises a plurality of mountings which are cooperable in use with screw couplings for adjusting the orientation of the image carriers.

19. A display apparatus comprising:

a set of image carriers each defining a respective sequence of image frames and each having directional properties such that different image frames are viewable from different viewing directions relative to the image carrier;

support means for supporting the image carriers such that they together form a composite display; and adjustment means operable to adjust the orientation of the image carriers relative to the support means such that corresponding frames of each image carrier are simultaneously viewable by an observer at a predetermined position relative to the display apparatus, each image carrier comprising a reference frame at a selected position in the sequence of image frames and indicia means facilitating recognition of the reference frame when viewed by the observer at the predetermined position, and wherein the reference frame of at least one of the image carriers is viewable in a viewing direction at 90° to a plane in which the image carrier extends and wherein the reference frame of at least one other of the image carriers of the set is viewable at an angle of less than 90° relative to a plane in which the at least one other image carrier extends.

* * * * *